United States Patent [19]

Foreman

[11] Patent Number: 4,840,219

[45] Date of Patent: Jun. 20, 1989

[54] MIXTURE AND METHOD FOR PREPARING CASTING CORES AND CORES PREPARED THEREBY

[76] Inventor: Robert W. Foreman, 4353 Covered Bridge Rd., Bloomfield Hills, Mich. 48013

[21] Appl. No.: 174,394

[22] Filed: Mar. 28, 1988

[51] Int. Cl.[4] ..... B22C 1/18; B22C 9/10

[52] U.S. Cl. ..... 164/369; 106/38.3; 106/38.9; 164/132; 164/138; 164/522; 164/528; 164/529

[58] Field of Search ..... 164/522, 132, 529, 528, 164/138, 369; 106/38.9, 38.3

[56] References Cited

U.S. PATENT DOCUMENTS 4,331,197 5/1982 Cole ..... 164/522

4,480,681 11/1984 Alexander et al. ..... 164/522

4,629,708 12/1986 Alexander et al. ..... 164/522 X

*Primary Examiner*—Nicholas P. Godici

*Assistant Examiner*—J. Reed Batten, Jr.

*Attorney, Agent, or Firm*—Krass & Young

[57] ABSTRACT

Casting cores are fabricated from a mixture comprising a molten salt having dispersed therein a particulate material which includes a first refractory material having a mesh size of 60-120 and a second refractory material having a mesh size of at least 200. The salts are preferably halides, carbonates, sulfates, sulfites, nitrates or nitrites of Group Ia and Group IIa metals and the refractory material may be selected so as to be non-reactive with the molten salt. Some preferred refractory materials include alumina and magnesium silicate.

15 Claims, No Drawings

MIXTURE AND METHOD FOR PREPARING CASTING CORES AND CORES PREPARED THEREBY

FIELD OF THE INVENTION

This invention relates generally to casting and more specifically to cores used in a casting process, particularly a metal casting process. The invention is advantageously adapted to the fabrication of reinforced, water disintegratable or thermally meltable cores particularly well suited for use in the casting of aluminum.

BACKGROUND OF THE INVENTION

Casting is a fabrication technique which is presently in widespread use in conjunction with a variety of materials. Casting of metals allows for the economical fabrication of variously shaped metallic items without the need for machining, stamping or other such metal working processes. In general, casting involves the introduction of molten material into a mold, cooling of the material and removal of the finished item from the mold.

In many instances the shape of the finished item is such that it is not readily removable from the mold. For example, the item may include undercut regions or other complex shapes precluding ready demolding. In other instances, it is desirable to fabricate a hollow article and in yet other instances it may be desirable to mold screw threads or other such features into a casting. In order to mold these various shapes, casting cores are generally employed. These cores are formed from a heat resistant material and are used to constrain the molten metal into a particular shape. For example, in the casting of a hollow article, a core will be placed in a mold so as to substantially fill the mold, leaving only a relatively thin "shell" to be filled by the subsequently introduced molten metal. In those instances where it is desirable to cast screw threads into a metal body, a screw shaped core is incorporated in the mold. After the cast metal has solidified, the core is removed leaving behind impressions of the screw threading.

After the casting process is complete it is necessary to remove the cores and toward that end they are frequently fabricated from a frangible material such as a sand/organic resin composite which may be readily broken out of the casting. While such sand cores are relatively cheap they are not capable of providing a high quality surface finish or maintaining precise dimensional tolerances and hence are not suitable for casting of precise shapes such as screw threads and the like.

Another approach to the problem of providing readily removable casting cores involves the use of ceramic coated synthetic polymeric foam bodies. In the casting procedure, the organic matter comprising the foam burns away while the ceramic facing provides for a smooth metal finish. This process is frequently called the "lost foam" process and provides higher quality casting than does a sand core process. Such cores are relatively difficult to fabricate, fragile, expensive, and not well suited for the casting of screw threads. For this reason alternatives to the lost foam process capable of providing high quality castings have been sought.

Many salts are capable of being melted and cast into a variety of shapes having a relatively smooth surface finish capable of withstanding high temperatures encountered in a metal casting process, hence efforts have been undertaken to use such materials as casting cores.

By use of an appropriately water soluble salt, such cores may be fabricated to be readily removed by a water wash process. U.S. Pat. No. 3,356,129 discloses the use of water soluble salt cores in a casting the process. In other instances, thermal energy may be utilized to melt a core out of a casting as will be explained in greater detail hereinbelow.

Problems can occur in the use of salt cores because of the physical properties of most readily available salt materials. Generally molten salt shrinks upon cooling making the maintenance of precise tolerances difficult. Additionally, such cast salt materials are relatively fragile and frequently manifest poor surface quality due to cracking, spalling and other damage thereto. In yet other instances cast salt materials are hygroscopic and tend to absorb atmospheric moisture which degrades the surface finish thereof; and in yet other instances the materials used for the cores react with the casting metal.

Control of thermally induced dimensional changes is very important in processes involving casting cores. As a first requirement, the core must not undergo extreme dimensional changes during its fabrication, since such changes can cause spalling, cracking or other surface damage to the core, as well as result in the loss of dimensional tolerances. Also, the core must be thermally stable during the casting process, that is to say it must not be damaged by thermal shock and it should have a thermal coefficient of expansion similar to the metal being cast. Heretofore employed salt cores tended to change dimensions significantly as they cooled from the melt; however, it has been found that cores prepared according to the present invention have high thermal stability. Another parameter to be considered in the use of casting cores is their thermal conductivity. In general, it is desired that casting cores have relatively low thermal conductivity, so as to prevent undue heating and possible melting of the core during the casting process. Low thermal conductivity eliminates distortion and edge melting of the cores, particularly where they are used at temperatures near their melting point.

Obviously, it would be desirable to increase the strength, dimensional stability and surface quality of salt cores so as to provide for the improved casting of materials particularly metals. U.S. Pat. No. 1,523,519 teaches the fabrication of for the vulcanization of rubber articles, which cores are fabricated from sodium and potassium nitrate combinations and which may be filled with an inert material such as mineral flour. As taught therein, the us of mineral flour lowers the cost of the casting mixture and also serves to weaken and embrittle the cast core so that it may be more readily broken up and removed from the finished article. There is no teaching whatsoever therein of the use of any reinforcing material in a cast salt core to increase the strength and/or surface finish thereof. U.S. Pat. No. 3,692,551 shows the manufacture of cores suited for the relatively low temperature casting of plastic resins. The cores of the '551 patent are manufactured from a molten salt which may include sand or other such inert filler material therein. There is no teaching in the '551 patent of any strength increasing or dimensional stabilizing function for the filler or the use of various combinations of filler particle size to obtain a high quality core.

U.S. Pat. No. 3,459,253 describes a process for casting cooling passages into pistons, which process relies upon the use of water-soluble, casting cores. As disclosed therein, the cores are preferably fabricated from a sulfate/carbonate salt mix and may include a unitary wire or glass fiber reinforcing matrix as well as optional fillers. The '253 patent does not teach or suggest the use of reinforcing and/or shrinkage reducing fillers comprised of two different size of particulates, nor does it discuss the role of a filler material in controlling dimensional stability.

It will be appreciated that there is a need for water soluble, water disintegratable or readily meltable cores for use in a metal casting process, particularly an aluminum casting process, which cores are cheap and easy to manufacture, provide a good surface finish resistant to atmospheric moisture and a high degree of strength and dimensional stability. The present invention provides for the manufacture of high quality casting cores from molten salt material reinforced with a substantially inert material having a particular size distribution. The cores of the present invention may be fabricated to have a coefficient of thermal expansion similar to that of aluminum. They are readily disintegrated in water or remelted to facilitate their ready removal and present a high quality, ceramic-like finish. These and other advantages of the present invention will be readily apparent from the discussion, examples and claims which follow.

SUMMARY OF THE INVENTION

There is disclosed herein a mixture for the preparation of a casting core. The mixture comprises 50–90% by weight of a fusible, water soluble salt and 10–50% of a particulate material substantially nonreactive with the salt and comprising a first refractory material having a mesh size of 60–120 and a second refractory material having a mesh size of at least 200.

The salt may be chosen from the group consisting essentially of: halides, carbonates, sulfates, sulfites, nitrates and nitrites of Group Ia and IIa metals and mixtures thereof. In some instances, the salt may comprise a carbonate and a chloride of a Group Ia and IIa metal as for example a mixture of NaCl and $Na_2CO_3$.

In a particular embodiment, the salt comprises approximately 60% NaCl and approximately 40% $Na_2CO_3$. In those instances where the cores are to be employed in an aluminum casting process it is generally preferred that the salt has a melting point in excess of 1225° F.

The refractory material may be chosen from the group consisting essentially of: alumina, magnesium silicate, sand and combinations thereof. In a particular embodiment, the particulate material comprises alumina of approximately 80 mesh as the first refractory material and alumina of at least 280 mesh as the second refractory material. The 80 mesh and 280 mesh alumina may be present in approximately equal proportions.

In one specific embodiment, the cores may be fabricated from a mixture wherein the fusible, water soluble salt is present in an approximately 60% by weight concentration and comprises a mixture of 60% sodium chloride and 40% sodium carbonate; the particulate material is present in an approximately 40% concentration by weight and comprises 50% alumina having a mesh size of approximately 80 and 50% alumina having a mesh size of at least 280.

The present invention also includes a method for preparing a water disintegratable casting core. The method includes the steps of providing a water soluble molten salt chosen from the group consisting essentially of halides, carbonates, sulfates, sulfites, nitrates and nitrites of Group Ia and Group IIa metals and mixtures thereof; dispersing 20–50% by weight of a particulate material in the molten salt, the particulate material being nonreactive with the salt and comprised of a first material having a mesh size of at least 60–120 and a second material having a mesh size of at least 280, and the further steps of casting the molten salt dispersion into a mold, cooling the mold and removing the cooled core from the mold.

DETAILED DESCRIPTION OF THE INVENTION

The present invention concerns an improved composition for fabrication of casting cores. As previously mentioned, use of salt based cores confers advantages in a casting process insofar as such cores may be readily removed from a casting by melting or washing out the material thereof. It is also known to include reinforcing materials in casting cores to increase their strength. The present invention is directed to a casting core comprised of a fusible salt and having a water insoluble material of a particular size distribution therein, the use of which confers particular advantages in terms of controlling shrinkage, increasing strength, particularly flexural strength and improving surface finish of the core. By "fusible salt" is meant a salt or mixture of salts which may be melted without decomposition or other reaction.

It has generally been found that a casting core can be fabricated from a mixture comprised of 50–90% of a fusible, water soluble salt and 10–50% of water insoluble material comprised of a first group of particles having a mesh size in the range of 60–120 and a second group of particles having a mesh size of at least 200. The combination of large and small mesh sizes produces a high strength core having a superior finish unattainable through the use of either size range of particles alone. The core may further include a fibrous material for increasing the strength thereof. This fibrous material may be utilized in addition to the aforementioned particulate material or may comprise the first and/or second group of particles.

It will be appreciated by those of skill in the art that mesh size is generally utilized to categorize particles of a roughly spherical shape; however, as noted, the refractory particles of the present invention may be fibers or other non-spherical shapes. Accordingly, as utilized herein, mesh size as applied to non-spherical particles shall define the size of the minimum dimension of the particle. For example, mesh size as applied to a fiber shall relate to the diameter of the fiber, and as applied to an ovoid shape, shall refer to the minor diameter of that ovoid.

A wide variety of salts may be employed in the practice of the present invention, the criteria being that the salts compatible with the material being cast, be amenable to melting in a practical temperature range, be water soluble and preferably low in cost. Among some of the salts which may be employed are the halides, carbonates, sulfates, sulfites, nitrates and nitrites of Group IA and IIA metals. By the appropriate choice of a single salt or a combination of the salts, a diverse range of melting points may be obtained. For example, mixtures of sodium nitrate and sodium nitrite may be compounded having melting points ranging from approximately 250° F. to temperatures in excess of 600° F. Such temperature ranges are compatible with the casting of low melting point materials such as plastics or particular metallic alloys and allow for easy handling and processing.

For the casting of higher melting materials it is generally preferred that high melting salt compositions be employed. For example, in the casting of aluminum, it is generally preferred that salt cores employed have a melting point in excess of 1225° F. and preferably in excels of 1300° F. A salt mixture comprised of sodium chloride and sodium carbonate may be advantageously employed for operation in this temperature range, as may be various sulfate mixtures. One particular composition having utility for the casting of aluminum is a mixture of approximately 60% sodium chloride and 40% sodium carbonate. In those instances where higher temperature ranges are desired, unmixed sodium carbonate or unmixed sodium chloride may be employed. It will thus be appreciated that one of skill in the chemical arts can readily select a proper salt or combination of salts which will accommodate a desired temperature range and provide for good water solubility.

The particulate material employed in conjunction with the salt may be similarly chosen from a wide group of refractory materials, generally defined as being resistant to high temperatures and including ceramics, composites, graphite fibers mixtures and the like. The criteria for selection requires that the particulate material be substantially non-reactive with the salt, capable of resisting temperatures employed to melt the salt, and be of the appropriate particle size. By non-reactive it is meant that the reinforcing material not form a by-product with the salt which is detrimental to the molding process. For example, it has been found that common sand cannot be employed in conjunction with carbonate-containing baths because of a reaction producing an insoluble, cement-like material not amenable to a washout procedure. Similar reactions have been found to occur between glass particles and carbonate baths. Alumina has been found to be a good material for use in a carbonate-containing bath insofar as it is substantially nonreactive therewith. It has also been found that magnesium silicate may be employed with a carbonate-containing bath. However, such material tends to thicken the bath; consequently, loadings must be kept to a 20% maximum. In those instances where carbonate-free sodium chloride is employed, masonry sand and glass particles may be used as a reinforcement with no adverse effect. Baths formed from lower melting salts such as the nitrates and nitrites are generally compatible with a wide variety of materials, including sand, alumina, magnesium oxide and the like.

The essential feature of the present invention is the fact that different sizes of particulate materials are employed to fabricate a cast core. In the case of a sodium chloride-sodium carbonate salt mixture loaded with alumina, it has been found that by using a first group of particles within the range of 60–120 mesh and a second group of particles of 200 mesh and above, a fine-textured durable casting is obtained. attempts to employ alumina particles of less than 60 mesh were unsuccessful insofar as the coarse alumina tended to settle out of suspension. 80 mesh alumina employed alone remained in suspension but produced cores having relatively poor integrity. Addition of finer mesh alumina improved the integrity and strength of the core.

There are no specific proportions required for the two different sizes of particulate material although it has been found most expedient and generally sufficient to utilize roughly similar amounts on a weight basis.

Various ancillary ingredients may be employed in conjunction with the fabrication of the cores of the present invention. For example, a small amount of fluxing agent may be included in the bath to facilitate formation of a tight bond between the salt and the particulate material. For example, materials such as fluoride salts or silicate compounds may be used to effect fluxing of alumina material. In those instances where sand is used as a reinforcing material, calcium oxide or other such alkaline materials can facilitate bonding.

After fabrication and prior to use in a molding process, it may be advantageous to coat the core with a mold release or slip agent to prevent unwanted sticking of the casting to the core. Coatings of this type confer further advantages insofar as they afford protection to the surface of the cores from moisture in the ambient atmosphere. Such materials are well-known to those of skill in the art and include compounds such as silicones, paraffin wax, heavy oils and the like frequently dissolved in a solvent such as mineral spirits. For high temperature applications, the slip agents may include graphite or molybdenum disulfide.

According to the present invention, there may be provided a pre-mix including the salt bath components and the reinforcing material. In such instance, the contents of the pre-mix are placed in a suitable vessel and heated to effect melting of the salt. Agitation or stirring is maintained to disperse the reinforcing material. In other instances, the salt and reinforcing material may be provided separately, the salt melted, and the reinforcing material mixed thereinto. In either instance, the dispersion of reinforcing material and molten salt is cast into an appropriate mold, cooled and demolded to provide a casting core. Casting may be by gravity methods, or in some instances pressure molding techniques may be employed.

As is well-known to those of skill in the casting arts, the core is suitably placed in a mold and a casting material such as for example, molten aluminum, is poured thereabout and allowed to harden. Alternatively, the core may be employed in a die casting or other pressure casting process. Removal of the core is accomplished by dissolution of the salt in water, which process may be facilitated by heating, agitation or ultrasonic vibration. The reinforcing material may simply be recovered from the water by filtering and, if desired, the salt may be recovered by evaporation.

The cores of the present invention may also be removed by melting them from the finished casting. Melting may be accomplished by immersion of the casting and core into a heated bath, oven heating, or in some instances microwave or inductive heating. In those instances where a heating process is employed, care must be taken to avoid distorting or melting the cast article. By appropriate choice of time and temperature conditions, such damage may be readily controlled. Logic would seem to indicate that conditions which would melt a core suitable for casting a material would also melt that material; however, such is not the case. It is possible to cast a material using a core having a melting point somewhat lower than the melting point of the casting material if the core and associated mold have sufficient heat capacity to chill the casting material before the core reaches its melting point. In such instances, a core may be advantageously removed by a simple heating process without melting the casting. In yet other instances, materials and conditions may be selected such that a core may be heated by induction or microwaves without causing significant heating to an associated casting.

The following examples are illustrative of the present invention as applied to an aluminum casting process.

EXAMPLE 1

Cores for the casting of aluminum were prepared by charging a mixture of approximately 37.0% sodium chloride, 25.83% sodium carbonate, 20.7% alumina of 80 mesh and 16.47% of alumina of 280 mesh and finer into a stainless steel melting pot. An air-driven agitator was disposed in the pot with the stirring propeller thereof about one inch from the bottom. The material in the pot was heated to a temperature of approximately 1500° F. and the minor was turned on as soon as the salt started to become fluid. Agitation was increased as the salt became totally melted so as to uniformly disperse the alumina particles.

In the meanwhile, a series of molds were prepared to receive the molten casting salt. These molds each defined a cavity having the shape of a screw-threaded stud and were fabricated as stainless steel split molds having a highly machined finish. The molds were preheated to approximately 500° F., which step has been found to minimize thermal shock in the cast part. The molds were filled with the molten dispersion, the salt allowed to solidify and the resultant core removed from the mold. Cores thus produced presented a smooth, porcelain-like gray-white finish. It was noted that, after about six hours of continuous heating and agitation, the salt mixture assumed a greenish-gray cast; however, this change was found to have no effect upon cores thus produced. It is believed that reaction of the salt with the interior of the melting pot is responsible for the color change.

The cores thus produced were employed in the casting of screw threads into an aluminum engine block. The cores were positioned in place in the block mold, molten aluminum introduced, and subsequently allowed to cool after which a high pressure stream of water was used to remove the cores, leaving behind a smoothly finished, threaded hole in the block.

EXAMPLE 2

A similar mixture was prepared to that of the foregoing example except that the amount of the salt in the mixture was approximately doubled so as to decrease the viscosity of the resultant dispersion. In this experiment, a mixture comprised of 48.7% sodium chloride, 32.7% sodium carbonate, 10.35% alumina of 80 mesh and 8.25% alumina of 280 mesh and finer was employed. This corresponded to proportions of approximately 80% salt and 20% reinforcing material. This material was melted under similar conditions and cast to provide core members also having excellent properties for a molding process.

EXAMPLE 3

In this example a mixture of approximately 30% sodium chloride, 20% sodium carbonate, 25% of 80 mesh alumina and 25% of alumina 280 mesh and finer was melted and cast as in the foregoing examples. It was found that while the 50% loading of reinforcing material gave a usable product, viscosity was quite high and it was anticipated that higher loadings of alumina would not be practical for this particular system.

EXAMPLE 4

The total viscosity of the salt bath will generally depend upon the temperature at which it is utilized, with higher temperatures giving lower viscosities. In this example, it was desired to prepare the casting cores at a temperature of approximately 1350° F., a temperature at which viscosity of the salt mixture would be expected to be relatively high. In order to accommodate the need for a lower viscosity, the amount of alumina was decreased so that the composition included 50% sodium chloride, 30% sodium carbonate, 10% 80 mesh alumina and 10% alumina of 280 mesh and greater. This mixture was cast into donut-shaped molds to produce cores having a ring-like configuration.

EXAMPLE 5

In this example, a mixture comprising 54% sodium chloride, 36% sodium carbonate, 5% alumina of 80 mesh and 5% alumina of 280 mesh and greater was melted as in the foregoing example and then cast into a screw thread mold similar to that in Example 1. Cores thus produced were durable and presented a smooth surface

EXAMPLE 6

In this example a mixture of 48% sodium chloride, 32% sodium carbonate, 10% magnesium silicate of 80 mesh and 10% magnesium silicate of 280 mesh and greater has employed in a process similar to that in the foregoing example. The molten mixture was quite viscous and it was anticipated that for this particular system, 20% loadings of magnesium silicate represent a practical maximum.

The foregoing examples are illustrative of some specific mixtures which may employed in the practice of the present invention. As mentioned previously, other salts such as nitrates and nitrites may be employed in a lower temperature process and other particulate materials such as sand, pulverized glass, glass fibers, mineral flour ceramic whiskers and the like may be employed. While the foregoing examples describe the use of alumina of 80 mesh and alumina of 280 and greater mesh, it will be appreciated that such particle size designations are nominal and that a first relatively coarse particulate material of approximately 60–120 mesh and a second relatively fine material of 200 mesh or greater may generally be employed according to the teaching herein.

In light of the foregoing it should be apparent to one of skill in the art that many modifications and variations of the present invention are possible. Accordingly, the foregoing discussion and examples are merely meant to be illustrative of particular embodiments of :he instant invention and not limitations upon the practice thereof. It is the following claims, including all equivalents, which define the scope of the invention.

I claim:

1. A mixture for the preparation of a casting core, said mixture comprising:

50–90% by weight of a fusible, water soluble salt; and

10–50% of a particulate material substantially nonreactive with the salt and comprising a first refractory material of a mesh size of 60–120 and a second refractory material of a mesh size of at least 200.

2. A mixture as in claim 1, wherein said salt is chosen from the group consisting essentially of:

halides, carbonates, sulfates, sulfites, nitrates and nitrites of Group Ia and IIa metals, and mixtures thereof.

3. A mixture as in claim 1, wherein said salt includes a chloride and a carbonate of a Group Ia metal.

4. A mixture as in claim 3, wherein said salt comprises a of NaCl and $Na_2CO_3$.

5. A mixture as in claim 4, wherein said salt comprises approximately 60% NaCl and approximately 40% $Na_2CO_3$.

6. A mixture as in claim 2, wherein said salt has a melting point in excess of 1225° F.

7. A mixture as in claim 1, wherein said refractory material is chosen from the group consisting essentially of: alumina, magnesium silicate, sand, and combinations thereof.

8. A mixture as in claim 1, wherein said particulate material comprises alumina of approximately 80 mesh as said first refractory material and alumina of at least 280 mesh as said second refractory material.

9. A mixture as in claim 8, said alumina of approximately 80 mesh and said alumina of at least 280 mesh are present in approximately equal proportions.

10. A mixture as in claim 1, wherein said fusible, water soluble salt is present in an approximately 60% by weight concentration and comprises a mixture of 60% sodium chloride and 40% sodium carbonate; and, wherein said particulate material is present in a 40% concentration by weight and comprises 50% alumina having a mesh size of approximately 80 and 50% alumina having a mesh size of at least 280.

11. A water disintegratable casting core comprised of:

50–90% of a salt chosen from the group consisting essentially of:

halides, carbonates, sulfates, sulfites, nitrates and nitrites of Group Ia and Group IIa metals, and mixtures thereof; and, 10–50% of a particulate material dispersed in the salt, said particulate material substantially non-reactive with the salt and comprised of a first, material having a mesh size of at least 60–20 and a second material having a mesh size of at least 280.

12. A method for preparing a water disintegratable casting core, including the steps of:

providing a water soluble molten salt chosen from the group consisting essentially of: halides, carbonates, sulfates, sulfites, nitrates and nitrites of Group Ia and Group IIa metals and mixtures thereof;

dispersing 10–50% by weight of a particulate material in said molten salt, the particulate material being non-reactive with the salt and comprised of a first refractory material having a mesh size of at least 60–120 and a second refractory material having a mesh size of at least 200;

casting the molten salt dispersion into a mold;

cooling the mold and the core contained therein; and removing the cooled core from the mold.

13. A method as in claim 12, wherein the step of providing a water soluble molten salt includes providing a mixture comprising approximately 60% NaCl and approximately 40% $Na_2CO_3$.

14. A method as in claim 12, wherein the step of dispersing a particulate material includes dispersing a material wherein said first refractory material comprises alumina of approximately 80 mesh and the second refractory material comprises alumina of a mesh size of at least 280.

15. A method as in claim 12, wherein the step of casting the molten dispersion into a mold comprises pressure casting the dispersion.

* * * * *